US006937923B1

(12) United States Patent
Bassett

(10) Patent No.: US 6,937,923 B1
(45) Date of Patent: Aug. 30, 2005

(54) CONTROLLER SYSTEM FOR DOWNHOLE APPLICATIONS

(75) Inventor: Lonnie Bassett, Casper, WY (US)

(73) Assignee: Weatherford/Lamb, Inc., Houston, TX (US)

( * ) Notice: Subject to any disclaimer, the term of this patent is extended or adjusted under 35 U.S.C. 154(b) by 663 days.

(21) Appl. No.: 09/704,260

(22) Filed: Nov. 1, 2000

(51) Int. Cl.[7] ..... G05D 11/00
(52) U.S. Cl. ..... 700/282; 700/285; 137/2; 73/1.16; 702/45
(58) Field of Search ..... 700/282, 288, 700/289; 137/2–12; 702/45–49; 73/1.16–1.36; 166/250.25, 250.15, 250.01

(56) References Cited

U.S. PATENT DOCUMENTS

| | | | | |
|---|---|---|---|---|
| 4,971,522 | A | 11/1990 | Butlin | 417/18 |
| 5,819,848 | A | 10/1998 | Rasmuson et al. | 166/250.15 |
| 5,941,305 | A | 8/1999 | Thrasher et al. | 166/53 |
| 6,119,781 | A | 9/2000 | Lemetayer et al. | 166/369 |

FOREIGN PATENT DOCUMENTS

| | | | |
|---|---|---|---|
| EP | 0 945 589 | A1 | 9/1999 |
| GB | 2 336 864 | A | 11/1999 |

OTHER PUBLICATIONS

International Search Report from the European Patent Office for International App. No. PCT/GB01/04686, dated Mar. 4, 2002.

*Primary Examiner*—Kidest Bahta
(74) *Attorney, Agent, or Firm*—Moser, Patterson & Sheridan, L.L.P.

(57) ABSTRACT

The present invention generally provides a closed feedback system for operating peripheral devices in response to environmental conditions. Illustrative environmental conditions include well bore pressure, line pressure, fluid levels, flow rates and the like. In one embodiment, a flow controller disposed in a fluid line is operated in response to operating variable readings (e.g., pressure and/or flow rate) taken in the flow line and/or a well bore. The variable measurements are then compared to target values. If necessary, the flow controller is closed or opened to control the rate of fluid flow through the flow line and thereby achieve the desired target values. In another embodiment, the operation of a pump motor is monitored. Operating variables, such as voltage, current and load, are measured and compared to target values. In the event of a difference between the actual values of the variables and the target values, the flow controller is adjusted to affect the head pressure on a pump being driven by the motor. In some cases, the motor operation may be halted or otherwise adjusted.

44 Claims, 2 Drawing Sheets

CONTROLLER SYSTEM FOR DOWNHOLE APPLICATIONS

BACKGROUND OF THE INVENTION

1. Field of the Invention

The present invention relates generally to closed-loop feedback systems. More specifically, the invention relates to a controller system configured to adjust the operation of peripheral devices in response to pre-selected operating variables.

2. Background of the Invention

The production of fluids (e.g., water and hydrocarbons) from wells (e.g., coal methane beds and oil wells) involves technologies that vary depending upon the characteristic of the well. While some wells are capable of producing under naturally induced reservoir pressures, more commonly encountered are well facilities which employ some form of an artificial lift production procedure. Certain general characteristics are, however, common to most oil and gas wells. For example, during the life of any producing well, the natural reservoir pressure decreases as gases and liquids are removed from the formation. As the natural downhole pressure of a well decreases, the well bore tends to fill up with liquids, such as oil and water, which block the flow of the formation gas into the borehole and reduce the output production from the well in the case of a gas well and comprise the production fluids themselves in the case of an oil well. In such wells, it is also conventional to periodically remove the accumulated liquids by artificial lift techniques which include plunger lift devices, gas lift devices and downhole pumps. In the case of oil wells within which the natural pressure is decreased to the point that oil does not spontaneously flow to the surface due to natural downhole pressures, fluid production may be maintained by artificial lift methods such as downhole pumps and by gas injection lift techniques. In addition, certain wells are frequently stimulated into increased production by secondary recovery techniques such as the injection of water and/or gas into the formation to maintain reservoir pressure and to cause a flow of fluids from the formation into the well bore.

With regard to downhole pumps, some degree of flexibility is needed in operating the pump as operating conditions change. For example, it is often necessary to adjust the rate of fluid flow through the flow line in order to maintain a desired head pressure. The desired head pressure is determined according to the need to prevent gas from entering the pump in addition to maintaining fluid flow through the pump. Failure to control the head pressure can result in conditions that adversely effect the motor and/or the pump. For example, common occurrences in down hole pumping include "gas lock," pump plugging, high motor voltage spikes, high or low motor current and other failure modes. Left unattended, these conditions can cause damage to the pump and/or motor.

One conventional solution to common operating problems is to use a Variable Speed Drive (VSD) to control the speed of the motor driving the pump. VSDs affect the motor speed by changing the frequency of the input signal to the motor. Increasing the frequency results in increased motor speed while decreasing the frequency decreases the motor speed. The magnitude of the speed adjustment is determined by monitoring a pressure sensor mounted on the pump. The pressure sensor measures the head pressure and transmits the pressure values back to a computer where the pressure value is compared to a predetermined target value (which may be stored in a memory device). If the measured pressure value is different from the target value, then the VSD operates to change the motor speed in order to equalize the head pressure with the target pressure. In this manner, the motor speed is periodically changed in response to continual head pressure measurements and comparisons.

Despite their effectiveness, the viability of VSDs is hampered by significant adverse effects that occur during their operation. One adverse effect is the introduction of harmonics. Harmonics are sinusoidal voltages or currents having frequencies that are whole multiples of the frequency at which the supply system is designed to operate (e.g., 50 Hz or 60 Hz). The harmonics are generated by switching the transistors that are part of the VSD. Harmonics are undesirable because they can cause damage to peripheral devices (e.g., household appliances such as televisions, microwaves, clocks and the like) that are serviced by the power company supplying power to the VSD. As a result, some power companies have placed restrictions on the use of VSDs.

In addition to the damage caused to peripheral devices, the pump motor and associated power cable may themselves be damaged. Specifically, the high peak-to-peak voltage spikes caused by switching the VSD transistors increases the motor temperature and can damage the motor power transmission cable (due to the large difference between the spike voltage and the insulation value of the cable). As a result, the chance for premature equipment failure is increased.

Therefore, there exists a need for a control system that allows for the operation of pumps and other devices without the shortcomings of the prior art.

SUMMARY OF THE INVENTION

The present invention is directed to a closed feedback system for operating peripheral devices (e.g., a flow controller) in response to operating information (e.g., environmental conditions). Illustrative operating information includes well bore pressure, line pressure, flow rates, fluid levels, and the like.

In one aspect, the invention provides a feedback system for a down hole pumping system. The down hole pumping system comprises a pump and a fluid line connected to the pump. The feedback system further comprises at least one sensor disposed and configured to collect operating variable information, a flow controller disposed in the fluid line, and a control unit coupled to the sensor. The control unit is configured to control operation of the flow controller in response to input received from the at least one sensor.

In another aspect, a feedback system for down hole applications, comprises a down hole pumping system comprising a pump, a motor connected to the pump, a fluid outlet line connected to the pump. The feedback system further comprises a flow controller disposed in the fluid outlet line, at least one sensor configured to collect operating information, and a control unit coupled to the down hole pumping system. The control unit is configured to process the operating information received from the at least one sensor to determine an operating variable value, compare the operating variable value with a target value, and then selectively issue a control signal to the flow controller.

In another aspect, a computer system for down hole applications is provided. The computer system comprises a processor and a memory containing a sensor program. When executed by the processor, the sensor program causes a method to be performed, the method comprising receiving a signal from at least one sensor configured to collect operating information from a down hole pumping system, processing the operating information to determine at least one operating variable value and comparing the operating variable value with a predetermined target value contained in the memory. If a difference between the operating variable value and the predetermined target value is greater than a threshold value, a flow control signal is output to a flow controller.

In another aspect, a method for operating a control unit to control peripheral devices while pumping a well bore is provided. The method comprises receiving a signal from at least one sensor configured to collect operating information from a down hole pumping system, processing the operating information to determine at least one operating variable value and comparing the operating variable value with a predetermined target value contained in the memory. If a difference between the operating variable value and the predetermined target value is greater than a threshold value, a flow control signal is output to a flow controller.

In another aspect, a signal bearing medium contains a program which, when executed by a processor, causes a feedback control method to be performed. The method comprises receiving an operating information signal from a down hole pumping system sensor and processing the operating information signal to determine at least one operating variable value. The operating variable value is then compared with a predetermined target value and, if a difference between the operating variable value and the predetermined target value is greater than a threshold value, a flow control signal is output to a flow controller.

BRIEF DESCRIPTION OF THE DRAWINGS

A more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

The present invention provides a closed feedback system for operating peripheral devices (e.g., a flow controller) in response to operating information (e.g., environmental conditions). Illustrative operating information includes well bore pressure, line pressure, flow rates, fluid levels, and the like. The following embodiment describes the operation of a flow controller disposed in a fluid line in response to operating variable values, e.g., pressure/flow readings taken in the flow line and the well bore. The pressure/flow measurements are then compared to target values. If necessary, the flow controller is closed or opened to control the rate of fluid flow through the line and thereby achieve the desired target values. In some situations a pump motor may be halted is the target values cannot be achieved. However, embodiments of the invention are not limited to controlling a flow controller or to measuring pressure/flow. For example, in another embodiment, motor operation variable values are measured and processed to determine the operation of a pump motor. Those skilled in the art will readily recognize other embodiments, within the scope of the invention, which use to advantage a closed loop feedback system for measuring a variety of variables in order to control peripheral devices.

Figure 1:
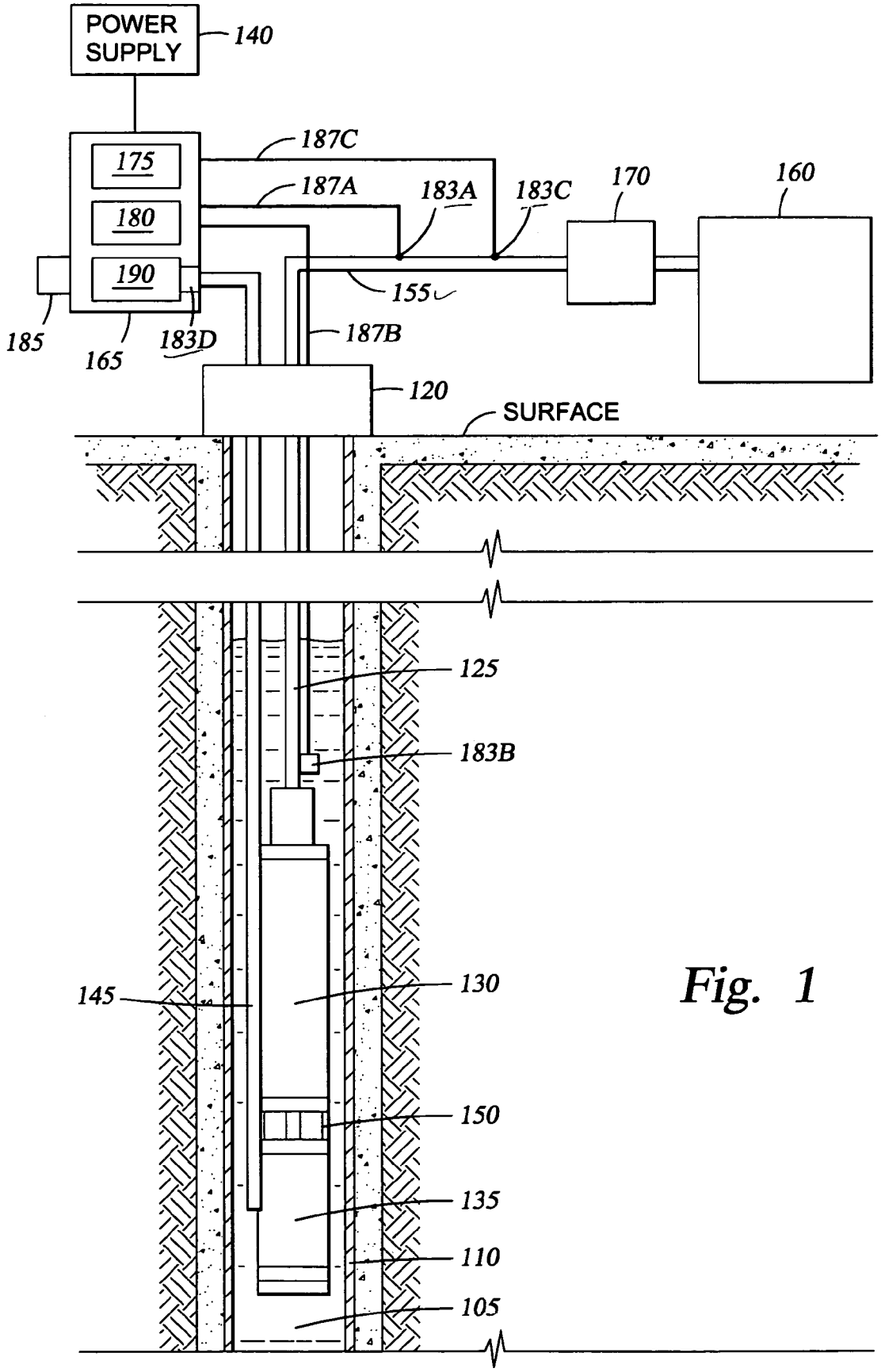
FIG. 1 is a side view of a well bore having a pumping system disposed therein; the pumping system is coupled to a control unit.

FIG. 1 shows a side view of a well bore 105 lined with casing 110. A submersible pumping system 115 disposed in the well bore 105 is suspended from a well head 120 by tubing 125. The pumping system 115 comprises a pump 130 and a motor 135. Exemplary submersible pumps are available from General Pump Manufacturer, Reda, and Centrilift. A particular pump is available from Weatherford International, Inc. as model number CBM30-MD. Exemplary motors are available from Exodyne, Hitachi, and Franklin Electric. Notably, the electric submersible pumping system 115 is merely illustrative. In other embodiments, the pump is not submersible and need not be electric. For example, the pumping system 115 may be a rod pump, a progressive cavity (PC) pump and the like.

Power is supplied to the motor 135 from a power supply 140 via a power cable 145. When the motor 135 is energized, the pump 130 is actuated and operates to draw fluid from the well bore 105 into intake ports 150 at a lower end of the pump 130. The fluid is then flowed upward through the pump 130, through the tubing 125 and into a flow line 155 (which may be an integral part of tubing 125) that extends from the well head 120. At a terminal end, the flow line 155 empties into a holding tank 160 where the fluid is deposited and later disposed of.

Delivery of power from the power supply 140 the motor 135 is selectively controlled by a control system 165. The control system 165 is also coupled to a flow controller 170 and a plurality of sensors 183A–D. In general, the control system 165 may be any combination of hardware and software configured to regulate the supply of power as well as control the operation of peripheral devices, such as the flow controller, as will be described below.

In one embodiment, the control system 165 comprises a disconnect switch 175 (e.g., a knife switch), a motor starter 180, a mode switch 185, and a computer system 190. The disconnect switch 175 provides a main switch having an ON position and OFF position. As an initial matter, operation of the pumping system 115 requires that the disconnect switch 175 be in the ON position. In this position, power is made available to the motor starter 180 and the computer system 190. In other embodiments, the computer system may be equipped with an alternative (or additional) power supply such as a battery pack. Subsequently, the mode switch 185 may be set to a desired position, e.g., manual, automatic or OFF. In an automatic position, the computer system 190 monitors selected variables (measured by the sensors) and provides appropriate output signals to peripheral devices, including the motor 135 and the flow controller 170, as will be described in detail below. In a manual position, the computer system 190 is bypassed and operation of the motor 135 and the flow controller 170 is manually performed by a human operator. In either case, the motor starter 185 may then be energized (e.g., by pushing a start button) in order to initiate operation of the motor 135.

In addition to regulating the supply of power to the motor 135, the control system 165 also provides control signals to a flow controller 170 disposed in the flow line 155. The flow controller 170 may be any device adapted to control the rate at which fluid flows through the flow line 155. Illustratively, the flow controller 170 is a gate style flow controller. An exemplary flow controller is the F100-300 available from Fisher. Other flow controllers that may be used to advantage are available from Allen Bradley.

During a pumping operation, selected variables are monitored by the computer system 190. Upon measuring the variables, the operating parameters of the motor 135 and the flow controller 170 may be changed by the computer system 190 in order to maintain target operating conditions. Measurement of the variables is facilitated by the provision of various sensors. Accordingly, a surface pressure sensor 183A is disposed in the flow line 155, downstream from the flow controller 170. The sensor 183A may be any device adapted to detect a line pressure in the flow line 155. An exemplary sensor is the PDIG-30-P available from Precision Digital. The output from the sensor 183A is delivered to the control system 165 via transmission cable 187A. The type of transmission cable used is dependent upon the signal to be propagated threrethrough from the sensor 183A. Illustratively, the signal is electrical and the transmission cable is copper wire.

In one embodiment, a flow rate sensor 183C (also referred to herein as a "flow rate meter" or "flow meter") is also disposed in the flow line 155. In a particular embodiment, the flow rate sensor 183C is integral to the flow controller 170. The flow rate sensor 183C may be any device adapted to measure a flow rate in the flow line 155. An exemplary sensor is the 10-500 available from Flowtronics. The output from the flow meter 183C is delivered to the control system 165 via transmission cable 187C. Embodiments contemplate having both the sensor 183A and the flow meter 183C disposed in the flow line 155. Alternatively, only one of either the sensor 183A or the flow meter 183C is disposed in the flow line 155. Further, even where both the sensor 183A and the flow meter 183C are provided, in some applications, only one is utilized to record readings.

A down hole pressure sensor 183B is located at an upper end of the pumping system 115. In particular, the sensor 183B is positioned adjacent an upper end of the pump 130 so that the sensor 183B remains submersed while the pump 183B is completely submersed. Illustratively, the sensor 183B is clamped to the flow line 155 at the outlet from the pump 130. In such a position, the down hole pressure sensor 183B is configured to measure the head pressure of the fluid in the well bore 105. An exemplary sensor is the PDIG-30-P available from Precision Digital. The output from the sensor 183B is delivered to the control system 165 via transmission cable 187B, which is selected according to the signal to be propagated threrethrough (e.g., electrical, optical, etc.).

Further, a motor sensor 183D is disposed in the control system 165 and is configured to measure selected variables during operation of the motor 135. Illustratively, such variables include current, load and voltage. In general, motor sensors include control transformers that can be electrically coupled to the power cable 145. An exemplary sensor is the CTI available from Electric Submersible Pump. Another sensor is the Vortex available from Centrilift. The output from the sensor 183D is delivered to the computer system 190 for processing.

Measurements made by the sensors 183A–D are transmitted as propagating signals (e.g., electrical, optical or audio depending on the sensor type) to the computer system 190 where the signals are processed. Depending on the value of the variables, control signals may be output by the computer system 190 in order to adjust the operating parameters of the motor 135 and/or flow controller 170. Accordingly, the computer system 190, the sensors 183A–D and the peripheral devices to be controlled (e.g., the motor 135 and the flow controller 170) make up a closed feedback loop. That is, the operation of the peripheral devices is dependent upon the variables being monitored and input to the computer system 190.

Figure 2:
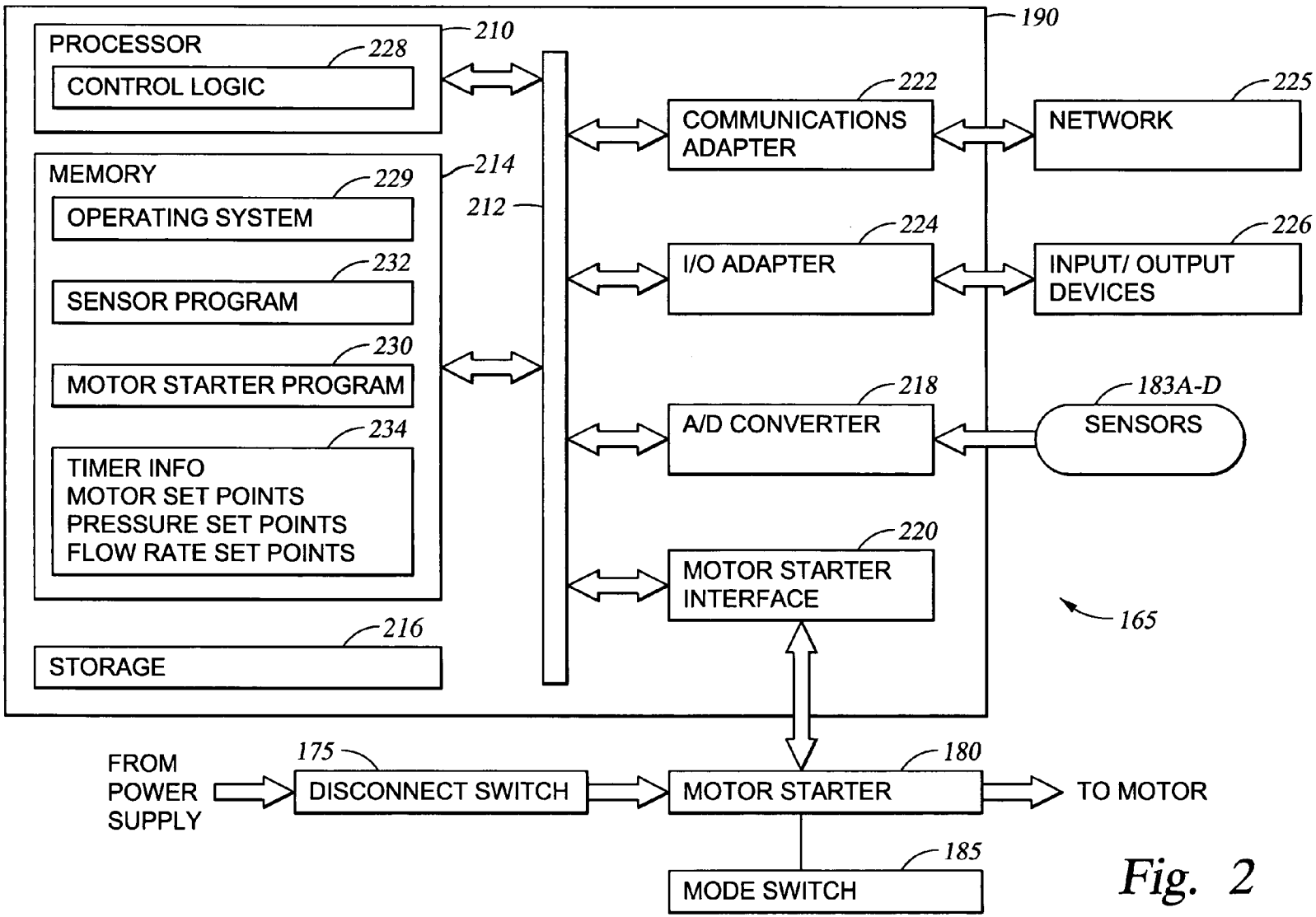
FIG. 2 is a high level schematic representation of a computer system.

A schematic diagram of the control system 165 is shown in FIG. 2. It should be noted that the control system 165 shown in FIG. 2 is merely illustrative. In general, the control system 165 may be any combination of hardware and software configured to execute the methods of the invention. Thus, while the control system 165 is described as an integrated microprocessing system comprising one or more processors on a common bus, in some embodiments the control system 165 may include programmable logic devices, each of which is programmed to carry out specific functions. For example, a first logic device may be programmed to respond to signals from the pressure/flow sensors 183A–C while a second logic device is programmed to respond to signals from the motor sensor unit 183D. Persons skilled in the art will recognize other embodiments.

As noted above, the control system 165 generally comprises the disconnect switch 175, the motor starter 180 and the computer system 190. The computer system 190 includes a processor 210 connected via a bus 212 to a memory 214, storage 216, and a plurality of interface devices 218, 220, 222, 224 configured as entry/exit devices for peripheral components (e.g. end user devices and network devices). The interface devices include an A/D converter 218 configured to convert incoming analog signal from the sensors 183A–D to digital signals recognizable by the processor 210. A motor starter interface 220 facilitates communication between the computer system 190 and the motor starter 180.

Embodiments of the invention contemplate remote access and control (e.g., wireless) of the computer system 190. Accordingly, in one embodiment, a communications adapter 222 interfaces the computer system 190 with a network 225 (e.g., a LAN or WAN).

Additionally, an I/O interface 224 enables communication between the computer system 190 and input/output devices 226. The input/output devices 226 can include any device to give input to the computer 190. For example, a keyboard, keypad, light-pen, touch-screen, track-ball, or speech recognition unit, audio/video player, and the like could be used. In addition, the input/output devices 226 can include any conventional display screen. Although they may be separate from one another, the input/output device 226 could be combined as integrated devices. For example, a display screen with an integrated touch-screen, and a display with an integrated keyboard, or a speech recognition unit combined with a text speech converter could be used.

The processor 210 includes control logic 228 that reads data (or instructions) from various locations in memory 212, I/O or other peripheral devices. The processor 210 may be any processor capable of supporting the functions of the invention. One processor that can be used to advantage is the Aquila embedded processor available from Acquila Automation. Although only one processor is shown, the computer system 190 may be a multiprocessor system in which processors operate in parallel with one another.

In a particular embodiment, memory 212 is random access memory sufficiently large to hold the necessary programming and data structures of the invention. While memory 212 is shown as a single entity, it should be understood that memory 212 may in fact comprise a plurality of modules, and that memory 212 may exist at multiple levels, from high speed registers and caches to lower speed but larger DRAM chips.

Memory 212 contains an operating system 229 to support execution of applications residing in memory 212. Illustrative applications include a motor sensor unit program 230 and a pressure sensor program 232. The programs 230, 232, when executed on processor 210, provide support for monitoring pre-selected variables and controlling the motor 135 and the flow controller 170, respectively, in response to the variables. In addition, memory 212 also includes a data structure 234 containing the variables to be monitored. Illustratively, the data structure 234 contains pressure set points, flow rate set points, timer set points, and motor set points (e.g., current, voltage and load). The parameters contained on the data structure 234 are configurable by an operator inputting data via the input/output devices 226 while the pumping system 115 is running or idle. In addition, the parameters may include default settings that are executed at startup unless otherwise specified by an operator. The contents of the memory 212 may be permanently stored on the storage device 214 and accessed as needed.

Storage device 214 is preferably a Direct Access Storage Device (DASD), although it is shown as a single unit, it could be a combination of fixed and/or removable storage devices, such as fixed disc drives, floppy disc drives, tape drives, removable memory cards, or optical storage. Memory 212 and storage 214 could be part of one virtual address space spanning multiple primary and secondary storage devices.

In one embodiment, the invention may be implemented as a computer program-product for use with a computer system. The programs defining the functions of the preferred embodiment (e.g., programs 230, 232) can be provided to a computer via a variety of signal-bearing media, which include but are not limited to, (i) information permanently stored on non-writable storage media (e.g. read-only memory devices within a computer such as read only CD-ROM disks readable by a CD-ROM or DVD drive; (ii) alterable information stored on a writable storage media (e.g. floppy disks within diskette drive or hard-disk drive); or (iii) information conveyed to a computer by communications medium, such as through a computer or telephone network, including wireless communication. Such signal-bearing media, when carrying computer-readable instructions that direct the functions of the present invention, represent alternative embodiments of the present invention. It may also be noted that portions of the product program may be developed and implemented independently, but when combined together are embodiments of the present invention.

During operation of the pumping system 115, conditions will arise which adversely effect the motor and/or the pump 130. For example, common occurrences in down hole pumping include "gas lock," pump plugging, high motor voltage spikes, high or low motor current and other failure modes. Left unattended, these conditions can cause damage to the pump 130 and/or motor 135. Accordingly, the present invention provides embodiments for monitoring and responding to select operating variables. In particular, the control system 165 receives input from the sensors 183A–D and processes the input to determine whether operating conditions are acceptable.

The operation of the control system 165, during execution of the sensor program 232, may be described with reference to FIG. 1 and FIG. 2. The following discussion assumes that the disconnect switch 175 is in the ON position to and the motor 135 is energized so that the pump 130 is operating to pump fluid from the well bore 105. In addition, it is assumed that the computer system 190 has been initialized and is configured with the appropriate timer information, pressure set points, flow rate set points and motor set points. Illustratively, the timer and set point information is permanently stored in storage 214 and written to the memory 212 by processor 210 when the computer system 190 is initialized. However, the information may also be manually provided by an operator at the time of startup.

Following initialization of the control system 165, the flow controller 170 maybe in a fully open position, thereby allowing unrestricted flow of fluid through the flowline 155 into the holding tank 160. During continued operation, the sensors 183A–C collect information which is transmitted to the computer 190 via the respective transmission cables 187A–C of the sensors 183A–C. The information received from the sensors 183A–C is then processed by the computer system 190 to determine pressure values and flow values, according to the sensor type. Specifically, the information received from the surface pressure sensor 183A is processed to determine a fluid pressure at a point within the flowline 155 downstream from the flow controller 170. The information received from the downhole pressure sensor 183B is processed to determine a head pressure of the fluid within the well bore 105. The flow meter 183C provides information regarding a flow rate in the flow line 155.

The calculated pressure/flow values are then compared to the pressure/flow setpoints contained in the data structure 234. A control signal is then selectively issued by the computer system 190, depending on the outcome of the comparison. In general, the computer system 190 takes steps to issue a control signal to the flow controller 170 in the event of a difference between the pressure/flow values and the pressure/flow setpoints. In some embodiments, the difference between the pressure/flow values to the pressure/flow setpoints must be greater than a threshold value before the control signal is sent. Such a threshold allows for a degree of tolerance which avoids issuing control signals when only a nominal difference exists between the actual and desired operating conditions. In any case, issuance of a control signal is said to be "selective" in that issuance depends on the outcome of the comparison between the measured pressure/flow values and the pressure/flow setpoints.

An issued control signal results in an adjustment to the flow controller 170. As described above, the flow controller 170 may initially be in a fully open position. Thus, a first control signal issued by the computer system 190 may be configured to close the flow controller 170. The degree to which the flow controller 170 is closed is selected according to the desired pressure within the flowline 155. More particularly, the setting of the flow controller 170 is selected to allow a high pumping speed while inhibiting gas flow into the pump 130. Subsequent readings from the sensors 183A–C are used to continually adjust the position of the flow controller 170 in order to maintain the desired pressure.

A typical operating pressure may be between about 25 psi and about 50 psi. During a pumping operations the pressure on the pump may vary due to changing conditions in the well for 105. By adjusting the setting of the flow controller 170 according to the feedback loop of the present invention, the pressure experienced by the pump may be maintained within desired limits.

It should be noted that while one embodiment measures the head pressure of fluid in the well bore 105 as well as the line pressure in the flow line 155, other embodiments measure only the head pressure (i.e., the well bore fluid pressure taken by sensor 183B) or only line pressure (i.e., taken by the surface sensor 183A). As between the two, the down hole sensor 183B is preferred. The surface sensor 183A merely provides additional information useful for identifying, for example, failure modes due to gas lock that would prevent fluid from flowing through the flow line 155. In the case of a submersible pump, however, the down hole sensor 183B provides important information about the head pressure of the fluid over the intake 150, which in many cases is necessary to maintain proper operation of the pump 130.

In addition to pressure and flow measurements received from the sensors 183A–C, readings from the motor sensor 183D are also used to advantage. Operating conditions are often experienced which can cause significant damage to the motor 135. For example, solids may enter the pump 130 and create drag stress on the motor 135. In the case of gas lock, the lack of fluid flowing through the pumping system 115 causes the motor 135 to run an extremely low loads. Therefore, the operating information collected by the motor sensor 183D is processed by the computer system 190 to determine whether the motor 135 is operating within preset limits (as defined by the motor set points). If the motor 135 is operating outside of the present limits, adjustments are made to the flow controller 170 in attempt to stabilize the operation of the motor 135. Consider, for example, a situation in which the computer system 190 determines a motor current below the motor current setpoint, indicating a possible gas lock. Corrective action by the computer system 190 may include signaling the flow controller 170 to close. This has the effect of increasing the pressure on the pump 130, thereby causing the gas to exit the pump 130 and flow upwardly through the well bore 105 between the pumping system 115 and the casing 110. The pumping system 115 may then continue to operate normally.

In some cases, however, the corrective action taken by the computer system 190 may not be effective in alleviating the undesirable condition. In such cases, it may be necessary to halt the operation of the motor 135 to avoid damage thereto. A determination of when to halt the operation of the motor 135 is facilitated by the timer information contained in the data structure 234. The timer information defines a delay period during which the corrective action is taken. If the undesirable condition has not been resolved at the expiration of the delay period, operation of the motor 135 is halted.

While the foregoing is directed to preferred embodiments of the present invention, other and further embodiments of the invention may be devised without departing from the basic scope thereof. The scope of the invention is determined by the claims that follow.

What is claimed is:

1. A feedback system for down hole applications, comprising:

a down hole pumping system, comprising:

a pump; and a fluid line connected to the pump;

at least one sensor disposed and configured to collect operating variable information;

a flow control valve disposed in the fluid line; and a control unit, which is not a variable speed drive control unit, coupled to the sensor and configured to control operation of the flow controller in response to input received from the at least one sensor.

2. The feedback system of claim 1, wherein the at least one sensor is disposed on the down hole pumping system.

3. The feedback system of claim 1, wherein the at least one sensor comprises at least one of a pressure sensor and a flow meter disposed in the fluid line.

4. The feedback system of claim 1, wherein the at least one sensor comprises a pressure sensor disposed at an upper end of the pump.

5. The feedback system of claim 1, wherein the flow controller is a gate style pressure valve.

6. The feedback system of claim 1, wherein the control unit is coupled to the down hole pumping system and is configured to control the operation of the down hole pumping system in response to the operating variable information.

7. The feedback system of claim 1, wherein the at least one sensor comprises a first pressure sensor disposed in the flow line and a second pressure sensor disposed at an upper end of the pump.

8. The feedback system of claim 1, wherein the operating variable information is selected from at least one of a pressure value and a flow rate value and wherein the processing system is configured to selectively issue a control signal to the flow controller according to a comparison between the operating variable information and one or more target values.

9. The feedback system of claim 8, wherein the processing system is configured with timer values that define a delay period before the control signal is issued.

10. The feedback system of claim 1, wherein the at least one sensor is configured to collect operating variable information comprising at least one of a current value, a voltage value and a load value.

11. The feedback system of claim 10, wherein the control unit is coupled to the down hole pumping system and is configured to control the operation of the down hole pumping system in response to the operating variable information.

12. The feedback system of claim 1, wherein the pumping system further comprises a motor coupled to the pump.

13. The feedback system of claim 12, wherein the at least one sensor comprises a motor sensor configured to collect operating variable information comprising at least one of a current value, a voltage value and a load value from the motor.

14. The feedback system of claim 13, wherein the control unit is coupled to the down hole pumping system and is configured to control the operation of the down hole pumping system in response to the operating variable information.

15. A feedback system for down hole applications, comprising:

a down hole pumping system, comprising:

a pump;

a motor connected to the pump; and a fluid outlet line connected to the pump;

a flow control valve disposed in the fluid outlet line;

at least one sensor configured to collect operating information; and a control unit, which is not a variable speed drive control unit, coupled to the down hole pumping system and the at least one sensor and configured to:

process the operating information received from the at least one sensor to determine an operating variable value;

compare the operating variable value with a target value; and then selectively issue a control signal to the flow controller.

16. The feedback system of claim 15, wherein selectively issuing the control signal to the flow controller comprises issuing the control signal if the operating variable value is different from the target value.

17. The feedback system of claim 15, wherein the at least one sensor comprises a fluid pressure sensor and a motor sensor configured to collect operating information comprising at least one of a current value, a voltage value and a load value from the motor.

18. The feedback system of claim 15, wherein the at least one sensor comprises a surface pressure sensor disposable in the fluid outlet line and a well bore pressure sensor disposable in the well bore.

19. The feedback system of claim 18, wherein the surface pressure sensor and the well bore pressure sensor are disposable downstream from the flow controller.

20. The feedback system of claim 15, wherein the at least one sensor comprises a motor operations sensor and wherein comparing the operating variable value with the target value determines whether an adverse motor operating condition exists.

21. The feedback system of claim 20, wherein, if the adverse motor operating condition exists, the control unit is configured to issue a motor halt signal if the adverse motor operating condition persists for a predetermined period of time after the control signal is issued.

22. The feedback system of claim 15, wherein the at least one sensor comprises a motor sensor.

23. The feedback system of claim 22, wherein the motor sensor is configured to collect operating information comprising at least one of a current value, a voltage value and a load value from the motor.

24. The feedback system of claim 23, wherein the control unit is configured to control the operation of the down hole pumping system in response to the operating information.

25. The feedback system of claim 23, wherein the control unit is configured to halt the operation of the down hole pumping system in response to the operating information.

26. A computer system for down hole applications, comprising:

a processor;

a memory containing a sensor program which, when executed by the processor, performs a method comprising:

receiving a signal from at least one sensor configured to collect operating information from a down hole pumping system;

processing the operating information to determine at least one operating variable value;

comparing the operating variable value with a predetermined target value contained in the memory; and if a difference between the operating variable value and the predetermined target value is greater than a threshold value, outputting a flow control signal to a flow control valve and not a motor control signal to vary a speed of a motor.

27. The computer system of claim 26, wherein the threshold value is zero.

28. The computer system of claim 26, wherein the at least one sensor comprises at least one a pressure sensor.

29. The computer system of claim 26, wherein the at least one sensor comprises at least one pressure sensor disposed in a fluid outlet line coupled to a down hole pumping system and having the flow controller disposed therein.

30. The computer system of claim 26, wherein the at least one sensor comprises at least one of a pressure sensor and a motor operations sensor.

31. The computer system of claim 26, wherein the at least one sensor comprises a fluid pressure sensor and a motor sensor configured to collect operating information comprising at least one of a current value, a voltage value and a load value from a pump motor.

32. The computer system of claim 26, wherein the at least one sensor comprises a motor operations sensor and wherein comparing the operating variable value with the target value determines whether an adverse motor operating condition exists.

33. The computer system of claim 32, wherein, if the adverse motor operating condition exists, the processor is configured to issue a motor halt signal if the adverse motor operating condition persists for a predetermined period of time after the control signal is issued.

34. A method for operating a control unit to control peripheral devices while pumping a well bore, comprising:

receiving a signal from at least one sensor configured to collect operating information from a down hole pumping system;

processing the operating information to determine at least one operating variable value;

comparing the operating variable value with a predetermined target value contained in the memory; and if a difference between the operating variable value and the predetermined target value is greater than a threshold value, outputting a flow control signal to a flow control valve and not a motor control signal to vary a speed of a motor.

35. The method of claim 34, wherein the threshold value is zero.

36. The method of claim 34, wherein the sensor is submersed in a fluid contained in the well bore.

37. The method of claim 34, wherein the sensor and the flow controller are disposed in a fluid line.

38. The method of claim 34, wherein the operating variable value is indicative of head pressure of fluid contained in the well bore.

39. The method of claim 34, further comprising receiving the flow control signal at the flow controller and adjusting the flow rate of well bore fluid through a flow line.

40. The method of claim 34, wherein the down hole pumping system comprises a pump and a pump motor and wherein the sensor is a motor sensor.

41. The method of claim 40, wherein the operating variable value collected by the motor sensor is indicative of at least one of current, voltage and load.

42. The method of claim 34, further comprising adjusting the operation of the motor a predetermined period of time after outputting the flow control signal.

43. The method of claim 42, wherein adjusting the operation of the motor comprises halting the motor.

44. A signal bearing medium containing a program which, when executed by a processor, causes a method to be performed, comprising:

receiving an operating information signal from a down hole pumping system sensor;

processing the operating information signal to determine at least one operating variable value;

comparing the operating variable value with a predetermined target value; and if a difference between the operating variable value and the predetermined target value is greater than a threshold value, outputting a flow control signal to a flow control valve and not a motor control signal to vary a speed of a motor.

* * * * *